US008123500B2

(12) United States Patent
Jüterbock et al.

(10) Patent No.: US 8,123,500 B2
(45) Date of Patent: Feb. 28, 2012

(54) DIAPHRAGM PUMP

(75) Inventors: Karsten Jüterbock, Wangen (DE); Angelo Basso, Milan (IT)

(73) Assignee: J. Wagner AG, Altstatten (CH)

( * ) Notice: Subject to any disclaimer, the term of this patent is extended or adjusted under 35 U.S.C. 154(b) by 856 days.

(21) Appl. No.: 11/400,581

(22) Filed: Apr. 7, 2006

(65) Prior Publication Data

US 2006/0257271 A1 Nov. 16, 2006

(30) Foreign Application Priority Data

Apr. 12, 2005 (EP) ..... 05008040

(51) Int. Cl.
*F04B 45/053* (2006.01)
*F04B 43/06* (2006.01)

(52) U.S. Cl. ..... 417/395; 417/340; 417/397; 417/536

(58) Field of Classification Search ..... 417/340, 417/389, 310, 364, 46, 63, 395, 383, 341, 417/393, 397, 534–536, 342; 92/98–100
See application file for complete search history.

(56) References Cited

U.S. PATENT DOCUMENTS 2,613,607 A * 10/1952 Sheen et al. ..... 417/388
(Continued)

FOREIGN PATENT DOCUMENTS

DE 19535745 C1 * 3/1997

OTHER PUBLICATIONS

References for EP1712796, Nov. 3, 2010; 1http://v3.espacenet.com/allCitations?DB=EPODOC&locale=en_EP&FT=D&CC=EP&NR=1712796A1&KC=A1.*

*Primary Examiner* — Devon Kramer
*Assistant Examiner* — Leonard Weinstein
(74) *Attorney, Agent, or Firm* — Pandiscio & Pandiscio

(57) ABSTRACT

In a diaphragm pump with two diaphragms disposed in a pump housing and actuated by an adjusting piston which can be acted on alternately and which is arranged in between the diaphragms, the diaphragms are fixed with curvatures facing one another, or a curvature facing away from one another, and two reaction spaces are formed between the diaphragms and a cylinder, the reaction spaces accommodating the adjusting piston and being filled with a hydraulic medium and connected together in a constrained arrangement by means of hydraulic linkage lines. Both diaphragms remain in position and do not fold over during a transition from a suction stroke to a pressure stroke, because the diaphragms are continuously in contact with the hydraulic lines and are thereby fixed in place, so that the diaphragms are not subjected to alternating loadings.

5 Claims, 3 Drawing Sheets

U.S. PATENT DOCUMENTS 4,818,191 A * 4/1989 Schlake ..... 417/390
4,975,026 A * 12/1990 Pruszenski, Jr. ..... 417/340
5,062,770 A * 11/1991 Story et al. ..... 417/46
5,067,684 A * 11/1991 Garnjost ..... 248/550
5,415,531 A * 5/1995 Cavanaugh ..... 417/397
5,616,012 A * 4/1997 Hillman et al. ..... 417/383
5,655,778 A * 8/1997 Cavanaugh ..... 277/315
5,664,940 A * 9/1997 Du ..... 417/393
5,833,439 A * 11/1998 Du ..... 417/393
6,343,539 B1 * 2/2002 Du ..... 92/100
6,435,845 B1 * 8/2002 Kennedy et al. ..... 417/395
6,474,961 B1 * 11/2002 Timmer et al. ..... 417/393
6,705,111 B1 * 3/2004 Rockenfeller et al. ..... 62/476
6,742,997 B2 * 6/2004 Murata ..... 417/395
6,824,364 B2 * 11/2004 Ross et al. ..... 417/199.1
6,957,652 B2 * 10/2005 Matsuoka ..... 128/204.26
2002/0144593 A1 * 10/2002 Pisoni et al. ..... 92/98 R
2003/0031086 A1 * 2/2003 Shikami et al. ..... 366/160.2

* cited by examiner

DIAPHRAGM PUMP

REFERENCE TO PRIOR PENDING PATENT APPLICATION

This patent application claims the benefit of pending prior European Patent Application No. 05008040.7, filed Apr. 12, 2005 by Karsten Jüterbock et al. for DIAPHRAGM PUMP, which patent application is hereby incorporated herein by reference.

BACKGROUND OF THE INVENTION

1. Field of the Invention

The present invention relates to a diaphragm pump with two diaphragms disposed in a pump housing which act on a fluid medium to be pumped, e.g. a paint, which diaphragms can be actuated by means of an adjusting piston arranged in between the diaphragms upon both sides of which a pressurized medium can act alternately and which diaphragms are supported in the terminal areas of two piston rods that are firmly connected to the adjusting piston.

2. Description of the Prior Art:

A diaphragm pump of this type is disclosed in DE 195 35 745 C1. In this embodiment, a further pressure space is assigned to each of the two diaphragms and the pressure spaces are separated from the pumping spaces by the diaphragms. In this case, pressurized medium is supplied in a controlled fashion to the pressure spaces synchronously to the adjustment movements of the drive piston of a pneumatic motor that is mechanically connected to the diaphragms, with the effect that although a pressure ratio is achieved, the complexity of the construction and the level of the investment required are both considerable.

This is because a separate control device is provided in between the pneumatic motor and one of the diaphragms, and this control device is susceptible to defects and large in size. However, the principal disadvantage is that each of the diaphragms folds over during the transition from a suction stroke to a pressure stroke and their flexing zones are highly stressed by the alternating tensile and compression loads. This leads to damage to the diaphragms after only a relatively short operating time, meaning that the diaphragms have to be renewed and interruptions in operation have to be accepted in such cases. Furthermore, the folding over of the diaphragms has an unfavorable effect on the pumping behavior of the diaphragm pump because changes in volume in the pumping spaces are unavoidable and the pumping flow pulsates as a result.

SUMMARY OF THE INVENTION

The task of the present invention is therefore to provide a diaphragm pump of the aforementioned type in such a way that the diaphragms are not subjected to alternating loads during operation, but rather retain their specified installation position at all times. Folding over of the diaphragms should therefore be prevented, with the effect that the stresses on them are low in spite of the high pumping pressures and accordingly the possibility of damage is almost excluded. The complexity of the structure required to achieve this should be kept low but nevertheless trouble-free operation should be provided over long periods with a straightforward design. Also, there should not be any changes in the volumes of the pumping spaces.

In accordance with the present invention, this is achieved in a diaphragm pump of the aforementioned type in that the two diaphragms are clamped with their curvature facing each other or with their curvature facing away from each other, in opposite directions in each case, with their external edge zones in a fixed location in the pump housing and with their internal edge zones on the adjustable piston rods and in that the two reaction spaces formed between the diaphragms and a cylinder accommodating the adjusting piston are filled with a hydraulic medium and are directly connected together by means of a hydraulic linkage.

In this case, the reaction spaces holding the hydraulic linkage assigned to the diaphragms and the connection lines connected to the reaction spaces are completely filled with a hydraulic medium and are configured so they are hermetically sealed, the hydraulic fluid forming the hydraulic linkage acted on by atmospheric pressure or a low pressure of up to 0.09 MPa, and the line connecting the two reaction spaces of the diaphragms is closed or sealed by a plug so it is fluid-tight. In this way, it is assured that the diaphragms are fixed in the specified position.

In order to seal the reaction spaces internally, it is advantageous to provide each with a bellows clamped at one end against the cylinder and at the other end against the piston rods. Each of the spaces enclosed by the bellows should always be connected to the immediately adjacent pressure space of the adjusting piston by means of one or more openings worked into the cylinder.

If a diaphragm pump is configured in accordance with the present invention, this guarantees that both diaphragms will always remain in approximately the specified installation position and will not fold over at the transition from a suction stroke to a pressure stroke. The sides of the diaphragms facing towards the cylinder are always in contact with the hydraulic linkage and this linkage does not allow the diaphragms to lift off, so therefore they are only exposed to tensile stress during adjustment movements and are therefore not subjected to alternating loads. The service life of the diaphragms can therefore be increased significantly without the need to design or configure them in any special way.

The structural complexity needed to reduce the susceptibility to malfunctions of diaphragm pumps of this kind due to diaphragm damage is small because it is merely necessary to select a certain convex or concave installation position for the diaphragms in relation to the cylinder and, in addition, they are rigidly connected together to a certain extent via the hydraulic linkage. The provided hydraulic linkage against which the diaphragms make contact over a wide area is particularly well suited to this purpose without the need for a mechanical linkage. The hydraulic linkage follows the corresponding adjustment movements of the diaphragms because the reaction spaces are connected together, meaning that the diaphragms cannot fold over and are only subjected to minor flexing movements. Diaphragms that are only subjected to tensile forces can therefore be designed to allow greater elastic deformation.

A further advantage is that no spatial expansions occur in the pumping spaces of the diaphragm pump following a change in direction, i.e. after changing over from a suction stroke to a pressure stroke or vice versa, which would, amongst other effects, briefly interrupt the pumping flow. As a result, no pulsation effects can be detected in the pumping line, which means that the operating behavior of the diaphragm pump configured in accordance with the present invention is improved.

BRIEF DESCRIPTION OF THE DRAWINGS

The drawings show a preferred embodiment of a diaphragm pump configured in accordance with the present invention, the details of which are explained below. In the drawings.

DESCRIPTION OF THE PREFERRED EMBODIMENTS

Figure 1:
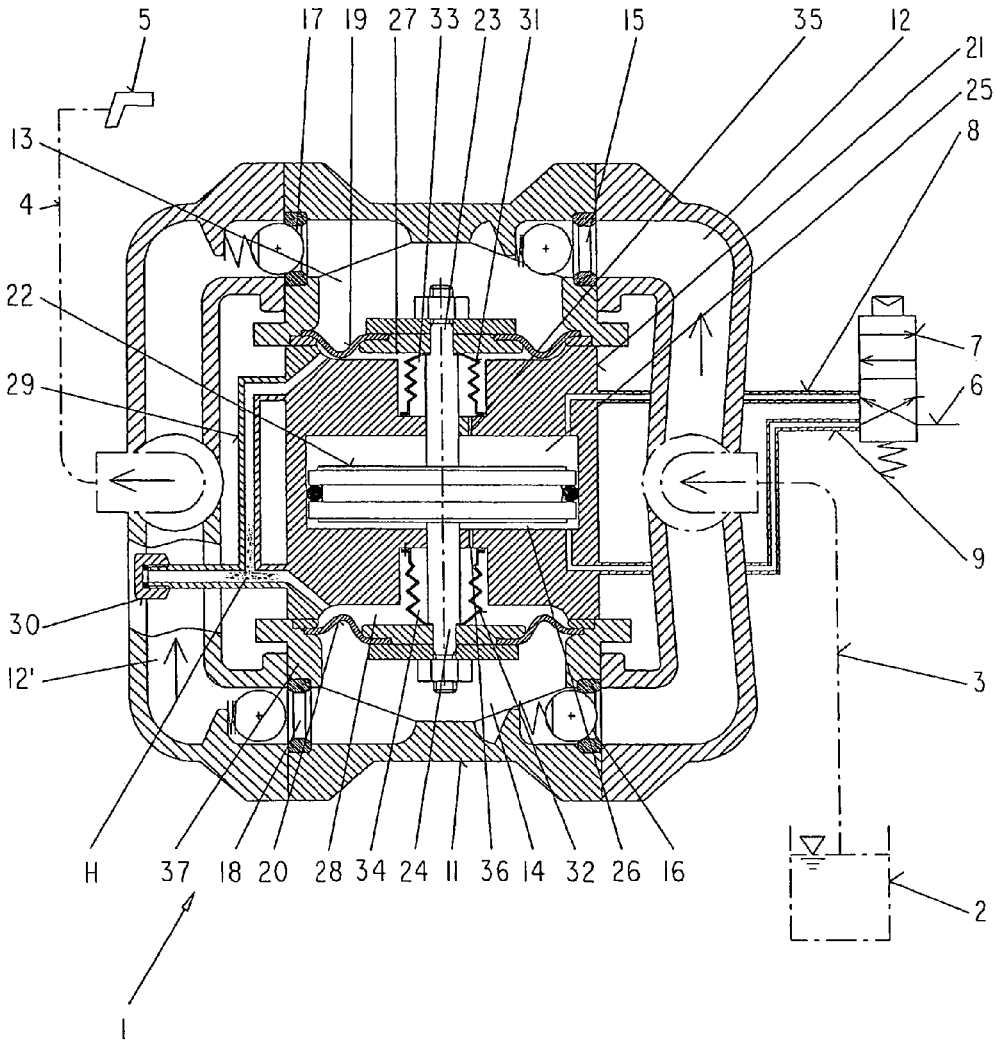
FIG. 1 shows an axial section of the diaphragm pump with associated peripheral devices represented in a schematic view.

The diaphragm pump shown in FIG. 1 and identified with 1 is used for pumping a liquid, for example a paint to be processed, out of a reservoir container 2 to a spray gun 5 and consists in principle of two diaphragms 19 and 20 arranged in a housing 11 being in a driven connection with an adjusting piston 22 upon which a pressurized medium can act alternately. A suction line 3 connects the diaphragm pump 1 to the reservoir container 2, while a pressure line 4 connects the diaphragm pump 1 to the spray gun 5.

In the embodiment illustrated, the adjusting piston 22 is arranged in a cylinder 21 installed between the two diaphragms 19 and 20 in a housing 11. Pressurized medium is supplied alternately to the pressure spaces 25 and 26 of the adjusting piston 22 in order to actuate the diaphragms, the pressurized medium being taken from a pressure line 6, and with a 4/2-way valve for inputting the pressurized medium into downstream pressure lines 8 or 9 that are connected to the pressure spaces 25 or 26.

Each of the diaphragms 19 and 20 is clamped with their external edge zones between disks 37 and the cylinder 21, with their inner edge zones, in contrast, held between disks 38 and 39 (FIG. 2) that are connected to piston rods 23 or 24 projecting from the adjusting piston 22. Clamping is performed in this case by a nut 40 screwed onto a threaded projection 24' of the piston rods 23, 24 with the effect that the disks 38 and 39 are supported against the piston rods 23, 24 that are offset in the edge zone, as can be seen in particular in FIG. 2.

Each of the diaphragms 19 and 20 has a pressure space 13 or 14 assigned to it, into which the medium to be pumped flows through a duct 12 connected to the suction line 3 and formed into the housing 11, with the flow also being via inlet valves 15 or 16. The medium to be pumped passes through outlet valves 17 or 18 connected downstream of the pressure spaces 13 and 14 into a duct 12' running as a mirror image to the duct 12 with duct 12' connected to the pressure line 4.

In the operating position of the diaphragm pump 1 that is illustrated, the medium to be processed is sucked into the into the pressure space 13 with the help of the diaphragm 19 driven by adjusting piston 22, whereas the medium in pressure space 14 is forced out by the diaphragm 20. The inlet valve 15 and the outlet valve 18 are open in this operating position but the inlet valve 16 and the outlet valve 17 are closed, with the effect that the medium can be sucked out of the reservoir container 2 via the suction line 3 and the duct 12 into the pressure space 13 and from the pressure space 14 via the duct 12' and the pressure line 4 to the spray gun 5.

A controlled changeover of a directional control valve 7 reverses the adjusting movement of the adjusting piston 22 and the diaphragms 19 and 20 that are firmly connected to it as soon as the pressurized medium from the pressure line 6 enters the pressure space 26 of the adjusting piston 22 via the pressure line 9. This means the inlet valve 15 is opened and the outlet valve 17 is closed. At the same time, the inlet valve 17 is closed and the outlet valve 15 is opened with the effect that the medium in the pressure space 13 is forced out and additional medium is sucked into the pressure space 14. As a result, pulsation-free pumping in the pressure line 4 is assured.

Figure 2:
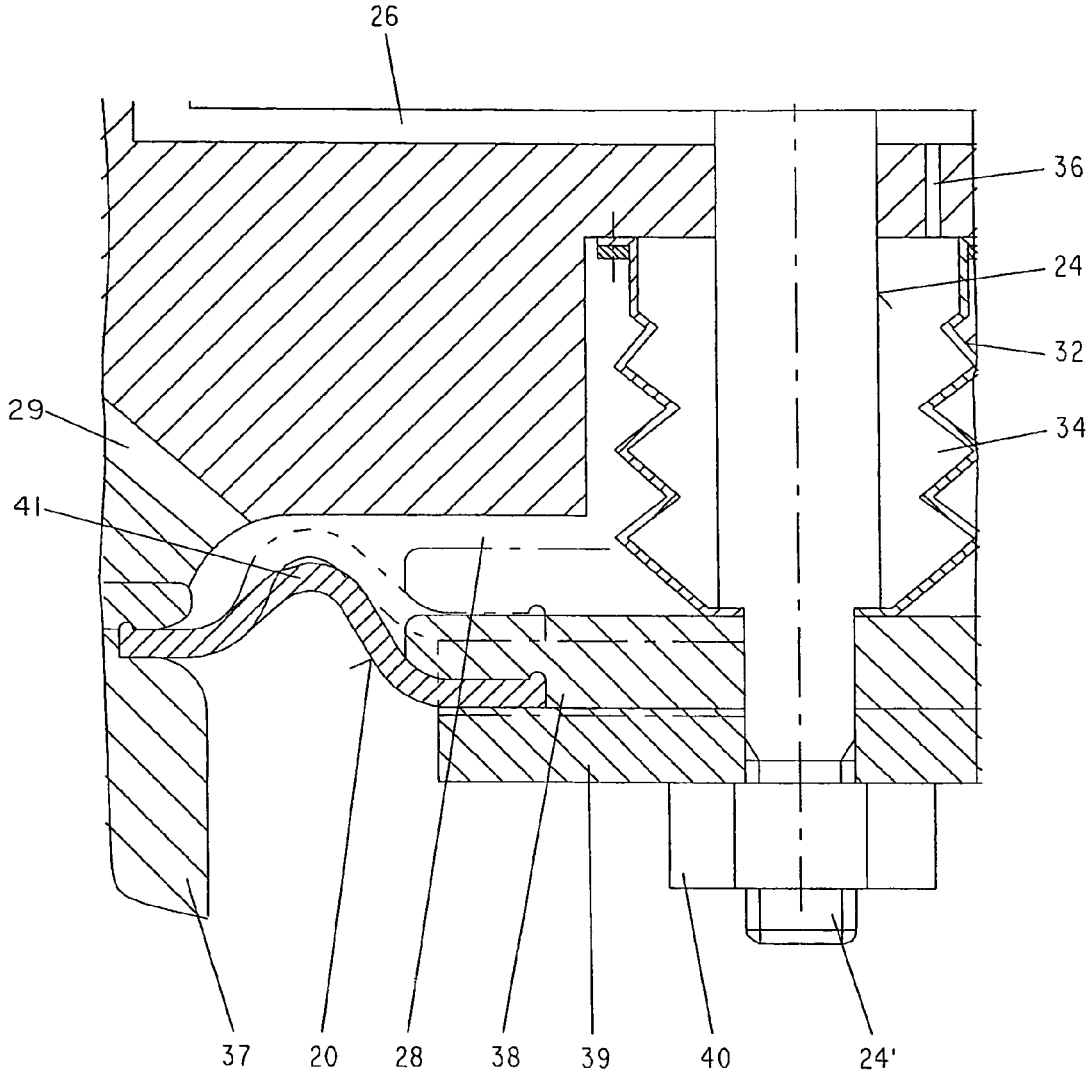
FIG. 2 shows a section of the diaphragm pump in accordance with FIG. 1 in a magnified view.
Figure 3:
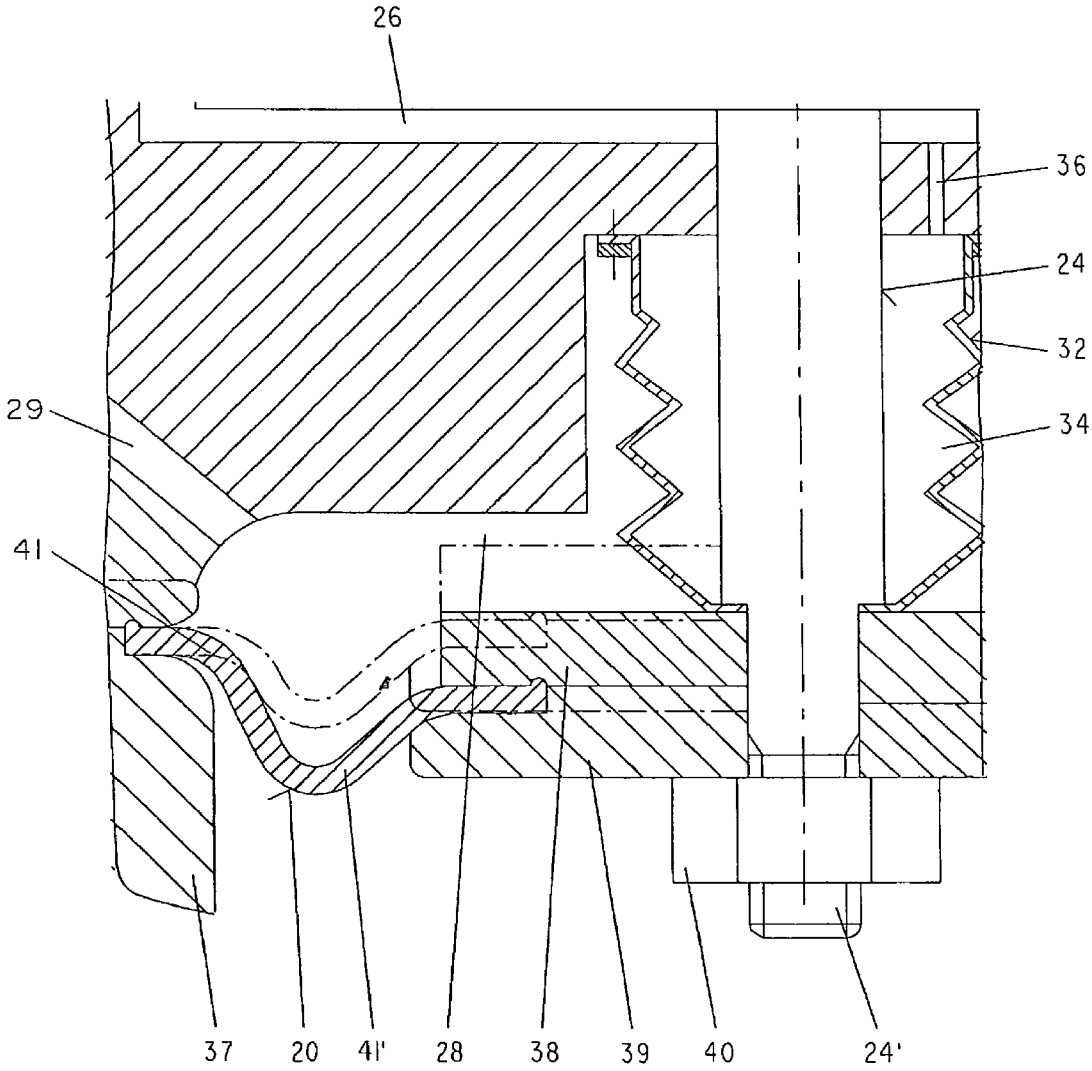
FIG. 3 shows a section from FIG. 2 with back-to-back curvature.

In the diaphragm pump, diaphragms 19 and 20 are clamped in such a way that their curvatures 41 or 41' are facing one another (FIG. 2) or facing away from one another (FIG. 3). In addition, reaction spaces 27 and 28 formed between the diaphragms 19 and 20, as well as the cylinder 21, are connected together by a line 29 that is sealed by a plug 30 so it is fluid-tight and are completely filled with a fluid that forms a hydraulic linkage H. The surfaces of the diaphragms 19 and 20 that face one another are therefore in contact with the hydraulic linkage H and are fixed in place by this linkage, because atmospheric pressure or a slight low pressure of up to 0.09 MPa acts on the hydraulic linkage H.

This means the diaphragms 19 and 20 cannot fold over when the adjusting movements are reversed, rather the diaphragms 19 and 20 remain in the illustrated position shown by dashed lines in FIGS. 2 and 3. During the adjusting movements, diaphragms 19 and 20 are only subjected to tensile stress, meaning that they can be configured in an elastically deformable manner in their flexing area and nevertheless achieve a long service life.

To preclude the fluid in the reaction spaces 27 and 28 passing through the piston rods 23 and 24 through penetrations in the cylinder 21 over the operating time and entering the pressure chambers 25 and/or 26 and therefore allowing a void to form in the reaction spaces 27 and 28, each of the reaction spaces 27 and 28 is firmly sealed by a bellows 31 or 32 in the area of the piston rods 23 and 24. The bellows 31 and 32 are clamped against the piston rods 23 and 24 at one end, while their other ends are attached to the cylinder 21. In addition, the spaces 33 or 34 enclosed by the bellows 31 and 32 are connected to the pressure spaces 25 and 26 via holes 35 or 36 worked into the cylinder 21, with the effect that the pressure is equalized automatically.

In the embodiment shown in FIG. 3, the two diaphragms 19, 20 of the diaphragm pump 1 have their curvatures 41' facing away from one another and are clamped in the external edge zone between the disks 37 and the cylinder 21 and in the internal edge zone between the disks 38 and 39. The reaction spaces 27 and 28 are also completely filled with a hydraulic fluid and have a communicating connection between them, therefore folding over of the diaphragms 19 and 20 is also excluded. Instead, they are supported on the hydraulic linkage H.

There is no need to account for changes in volume of the pressure spaces 13 and 14 caused by folding over of the diaphragms 19 and/or 20 because the hydraulic linkage H fixes the diaphragms 19 and 20 in position, which means that the diaphragm pump 1 can be used for supplying the medium to be processed to the spray gun 5 without pulsations. Also, the diaphragms 19 and 20 are only subjected to tensile stress and therefore it is possible to guarantee that the diaphragm pump 1 will operate without malfunctions over a long period.

The invention claimed is:

1. A diaphragm pump with two diaphragms disposed in a pump housing and adapted to act on a fluid medium to be pumped, the diaphragms each being actuated by a piston adapted to reciprocate between the diaphragms and upon both sides of which a pressurized medium can act alternately, the diaphragms being supported, respectively, in terminal areas of two piston rods connected to the piston, wherein each of the two diaphragms is clamped with a respective annular curvature and the annular curvatures are arranged to do a selected one of (1) face each other, and (2) face away from each other in opposite directions, wherein each annular curvatures has an external edge zone in a fixed location in the pump housing and an internal edge zone fixed on a respective disk that is fixed to a free end of a respective piston rod, wherein the annular curvatures of the diaphragm are not reversed nor flattened during operation of the pump;

wherein two reaction spaces are formed between the diaphragms and a cylinder housing the piston, wherein the reaction spaces are connected together by means of hydraulic conduits in communication with the reaction spaces, and wherein the reaction spaces and the hydraulic conduits are filled with hydraulic fluid and hermetically sealed;

wherein in order to seal the reaction spaces internally, each reaction space is provided with a bellows fixed at one end to the cylinder and at an other end to the respective disk fixed to the free end of the respective piston rod associated with each reaction space;

wherein each of the bellows encloses a space separated from a respective reaction space and wherein each space is in communication with a respective adjacent pressure space of the piston by means of a respective opening in the cylinder.

2. The diaphragm pump in accordance with claim 1, wherein the hydraulic fluid in the hydraulic conduits is acted upon by a selected one of (1) atmospheric pressure and (2) a low pressure of up to 0.09 MPa.

3. The diaphragm pump in accordance with claim 1, wherein the hydraulic conduits extend in part outside of said cylinder and parallel to walls of said cylinder and in part through the walls of said cylinder and at acute angles to walls of said cylinder.

4. The diaphragm pump in accordance with claim 1, wherein said annular curvatures of said diaphragms are minimally flexed in operation of the pump, such that a medium pumped by the pump is substantially free of pulsations.

5. A diaphragm pump, comprising:

a housing first and second diaphragms disposed in said housing and adapted to be acted upon by a hydraulic medium;

an adjusting piston disposed between said first and second diaphragms, said adjusting piston having piston rods extending therefrom, each of the piston rods being connected to one of said first and second diaphragms;

wherein said first and second diaphragms are fixed within the housing on peripheries thereof and face a selected one of (1) each other and (2) away from each other, wherein an internal edge of each of said first and second diaphragms is fixed to a respective disk fixed to a respective piston rod;

wherein reaction spaces are formed between the first and second diaphragms and a cylinder housing the piston therein and having a hydraulic medium therein;

wherein said reaction spaces are filled with the hydraulic medium and are connected together by a hydraulic linkage;

wherein said first and second diaphragms are fixed in respective positions in the diaphragm pump;

wherein said first and second diaphragms are provided with annular curvatures which are maintained without reversal of the annular curvatures by fluid pressures in said reaction spaces, which fluid pressure in operation of the diaphragm pump undergo continuous pressure changes; and wherein a bellows is provided in each of the reaction spaces, the bellows each extending around one of the piston rods and extending from one of the disks to the cylinder and defining spaces interconnected by openings in the cylinder extending from the interiors of the bellows to a pressure space in the cylinder.

* * * * *